US006478584B2

(12) United States Patent
Vile et al.

(10) Patent No.: US 6,478,584 B2
(45) Date of Patent: Nov. 12, 2002

(54) ELECTRICAL SIGNAL COUPLING DEVICE

(75) Inventors: David Daniel George Vile, Upper Heyford; John Beckley, Oxford, both of (GB)

(73) Assignee: Transense Technologies PLC (GB)

( * ) Notice: Subject to any disclaimer, the term of this patent is extended or adjusted under 35 U.S.C. 154(b) by 0 days.

(21) Appl. No.: 09/767,559

(22) Filed: Jan. 23, 2001

(65) Prior Publication Data

US 2001/0008810 A1 Jul. 19, 2001

Related U.S. Application Data

(63) Continuation of application No. PCT/GB00/02009, filed on May 25, 2000.

(30) Foreign Application Priority Data

May 25, 1999 (GB) ..... 9912201

(51) Int. Cl.[7] ..... H01R 39/00
(52) U.S. Cl. ..... 439/13; 439/17
(58) Field of Search ..... 439/13, 17, 19

(56) References Cited

U.S. PATENT DOCUMENTS 3,596,225 A * 7/1971 Cary ..... 339/5
3,771,830 A * 11/1973 Hartley et al. ..... 299/1
3,806,670 A * 4/1974 Van Toorn ..... 191/12
3,842,301 A * 10/1974 Smith ..... 310/232
4,516,097 A 5/1985 Munson et al.
4,548,454 A * 10/1985 Zeller et al. ..... 339/3
5,454,724 A * 10/1995 Kloeppel et al. ..... 439/17
5,498,163 A * 3/1996 Takamura et al. ..... 439/13
5,588,843 A * 12/1996 Sobhani ..... 439/22
5,829,986 A * 11/1998 Kong ..... 439/13
5,851,120 A * 12/1998 Sobhani ..... 439/17
5,914,547 A * 6/1999 Barahia et al. ..... 310/71
6,093,028 A * 7/2000 Yang ..... 439/13
6,190,180 B1 * 2/2001 Purington et al. ..... 439/17

FOREIGN PATENT DOCUMENTS

GB 2 328 086 2/1999

* cited by examiner

*Primary Examiner*—P. Austin Bradley
*Assistant Examiner*—Edwin A. Léon
(74) *Attorney, Agent, or Firm*—Keusey, Tutunjian & Bitetto, P.C.

(57) ABSTRACT

An electrical signal coupling device and more particularly, a rotary signal coupler suitable for use in transmitting electrical signals between transducers mounted on a shaft and wiring which is fixed relative to the structure in which the shaft is rotatably mounted. The coupling device includes a first part mounted on a rotary shaft and a second part mounted on the shaft in juxtaposition to the first part. The first and second parts include respective first and second conductors for electrically coupling the parts. The coupling device also includes means for maintaining a predetermined and substantially constant annular gap between the first and second parts and means, disposed on the second part, for preventing rotation of the second part as the first part rotates with the shaft.

9 Claims, 3 Drawing Sheets

Fig.4·1.
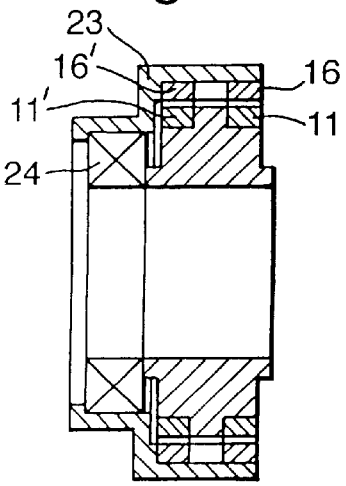
Fig.4·2.
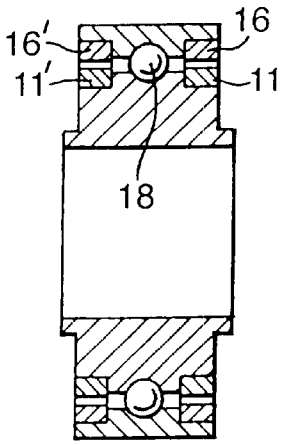
Fig.4·3.
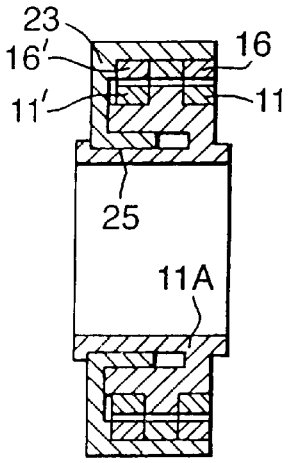
Fig.4·4.
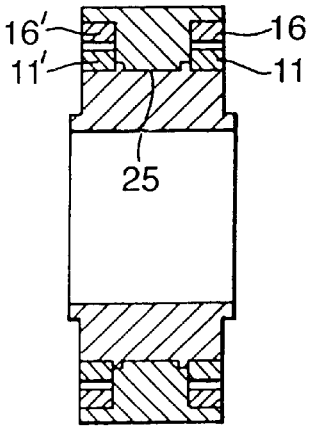
Fig.4·5.
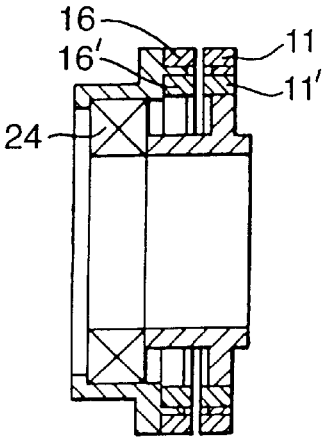
Fig.4·6.
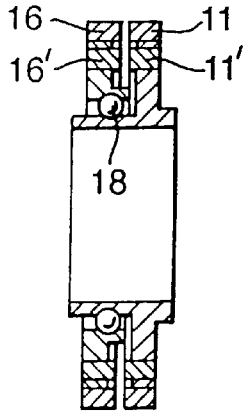

ELECTRICAL SIGNAL COUPLING DEVICE

RELATED APPLICATION DATA

This application is a Continuation of International Application (WIPO) No. PCT/GB00/02009 filed May 25, 2000, that designates the United States and which claims priority from British Application No. 9912201.2, filed May 25, 1999.

BACKGROUND OF THE INVENTION

1. Field of the Invention

This invention relates to an electrical signal coupling device and more particularly to a rotary signal coupler suitable for use in transmitting electrical signals between transducers mounted on a shaft and wiring which is fixed relative to the structure in which the shaft is rotatably mounted.

2. Prior Art

The invention is particularly applicable to rotary signal couplers for use in torque measuring equipment for example of the type described in our patent application GB-A-2328086. It is to be understood, however, that the invention is not limited to such applications and the electrical signal coupling device of the present invention may be used in other applications where it is necessary to establish a signal path between fixed wiring and transducers located on a shaft which is rotatable relative to the fixed wiring.

A known rotary signal coupler comprises a first part which is mounted on a rotatable shaft and a second part which is mounted on a housing in which the shaft is rotatably mounted. Such an arrangement is illustrated in FIG. 1. The first part 1 of the coupler includes conductors forming a transmission line which is connected to a SAW transducers 2 which is secured to the surface of a shaft 4. The first coupling part 1 is mounted on a sleeve 5 which is itself secured to the shaft 4 for rotation therewith. The second part 6 of the coupler comprises conductors which form a transmission line for coupling with the transmission line on the first part 1. Wires lead from the second part 6 to fixed circuitry which provides signals for exciting the SAW device 2 and analyses the effects of the distortion of the SAW device to provide a measure of the torque applied to the shaft 4. The second part 6 is secured to a housing 7 in which the shaft 4 is mounted via bearings 8, 9. In the arrangement shown in FIG. 1 a second rotary coupler comprising a first coupling part 1' and a second coupling part 6' is provided to facilitate connection to a second SAW device 3.

The type of arrangement illustrated in FIG. 1 suffers from the disadvantage that as a result of manufacturing tolerances it is difficult to maintain a consistent air gap between the first part 1 (or 1') and the second part 6 (or 6') of the coupler. Further, as the shaft 4 is rotated relative to the housing 7 the spacing between the first and second parts of the couplers is liable to vary as a result of eccentricity in the various components used. The inconsistent air gap between the first and second parts of the couplers, and the variation in the size of this air gap as the shaft rotates, makes it very difficult to interpret the signals derived from the SAW devices and limits the accuracy with which torque can be measured.

SUMMARY OF THE INVENTION

With a view to obviating the disadvantages outlined above, the present invention provides an electrical signal coupling device comprising a first part mountable on a rotary shaft; a second part mountable on the rotary shaft in juxtaposition to the first part, the first and second parts including respective conductors for electrically coupling the first and second parts; means for maintaining a predetermined and substantially constant annular gap between the first and second parts; and means provided on the second part for preventing rotation of the second part as the first part rotates with the shaft.

In the usual case where the coupling device is mounted with a housing which itself mounts the shaft, the housing will be provided with a clearance space surrounding the second part of the coupling device, and the coupling device will be provided with means for engaging the housing to prevent rotation of the second part. With such an arrangement, as the first part of the coupling device rotates with the shaft the second part of the coupling device will be restrained against rotation but will be maintained at a constant gap from the first part. If as a result there is radial or longitudinal movement of the second part relative to the housing this will be accommodated by the clearance space therebetween. Nonetheless, rotation of the second part will be prevented by the rotation prevention means.

In one embodiment of the invention the second part of the coupling device is mounted on the first part of the coupling device by means of a plain bearing, a ball-bearing or a roller bearing. In an alternative arrangement the second part is mounted on the shaft by way of a bearing and is positioned to be maintained adjacent the first part by the bearing. Rotation of the shaft will be accommodated by the bearing which mounts the second part of the coupling device. Because this bearing can be located immediately adjacent to the member which supports the first part on the shaft, relative lateral or longitudinal movement of the first and second parts will not occur during rotation of the shaft.

BRIEF DESCRIPTION OF THE DRAWINGS

The above and further features and advantages of the invention will become clear from the following description of a preferred embodiment thereof, given by way of example only, reference being had to the accompanying drawings wherein:

FIGS. 4.1–4.6 illustrate further embodiments of the present invention.

DETAILED DESCRIPTION OF THE PREFERRED EMBODIMENTS

Figure 2:
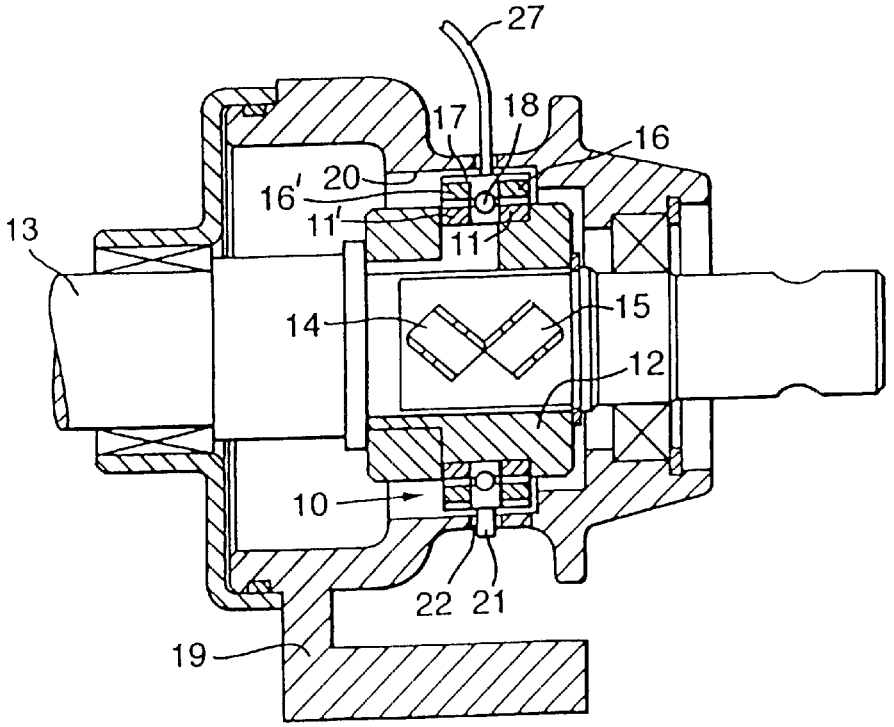
FIG. 2 illustrates schematically an embodiment of the present invention.

Referring to FIG. 2 the illustrated electrical coupling device 10 comprises a first part 11 which is mounted on a collar 12 which is itself mounted on a shaft 3. The first part 11 includes electrical conductors which form a transmission line. These conductors are connected to a SAW transducer 15 which is itself mounted on the surface of the shaft 13. The first coupling part 11 is surrounded by a second coupling part 16 which includes a transmission line which electrically couples with the transmission line of the first part 11 in use of the device. The second coupling part 16 is mounted in a carrier 17 which is mounted on the first part by means of a ball-bearing 18. The ball-bearing 18 is formed by an inner race provided in the outer surface of the collar 12, an outer race formed on the inner surface of the crier 17, and a multiplicity of balls. The exact form of the bearing is not critical to the present invention and any ball, roller or plain bearing arrangement will suffice. The carrier 17 also carries the second part 16' of a second coupling device, the first part 11' of which is mounted on the collar 12 and is connected to a second SAW device 14.

A cable 27 extends from the transmission lines of the second parts 16, 16' to appropriate electronic circuits which provide emerging signals for the SAW devices and analyze the signals produced by the SAW devices to measure the torque applied to the shaft 13.

Because the second parts 16, 16' of the coupling devices are mounted on the collar 12 by way of a bearing the second parts 16, 16' and the first parts 11, 11' are concentric to a high degree of accuracy and remain concentric as one part rotates relative to the other.

In order to allow for manufacturing tolerances and possible eccentricity of the shaft 13 relative to the housing 19 in which it is mounted, the carrier 17 of the coupling device is mounted within a clearance 20 formed in the housing 19. Both radial and axial clearances are provided around the carrier 37 to accommodate component part and assembly variations. A pin 21 secured to the carrier 17 is located in a clearance hole 22 provided in the housing to prevent rotation of the carrier 17, and thus the second parts 16, 16' relative to the housing. This arrangement ensures that no strain is put on the connecting cable 27 but at the same time permits the coupling device is free to move relative to the housing to a limited extent as the shaft rotates.

Whilst, in the case of the arrangement illustrated in FIG. 2, the second part 16, 16' of the couplings are mounted directly on the first parts 11, 11' by means of the ball-bearing 18, other arrangements are possible within the scope of the present invention.

Figure 3:
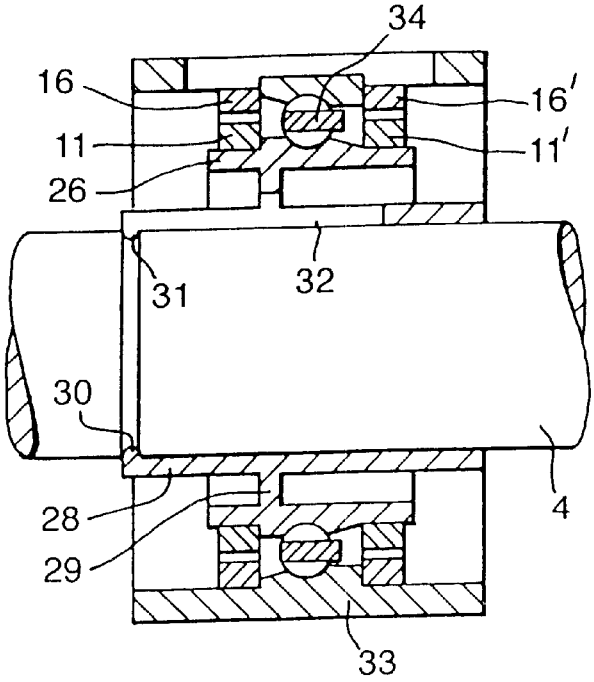
FIG. 3 illustrates schematically a second embodiment of the present invention.

An alternate embodiment of the invention is illustrated in FIG. 3. In this embodiment the first parts 11, 11' of the coupling devices are mounted on an inner carrier 26 which itself is secured to a sleeve 28 by means of a radially extending web 29. The sleeve 28 is retained on the shaft 4 by a ridge 30 formed integrally with the sleeve which is received in a groove 31 formed in the shaft. The sleeve 28 is retained against rotation relative to the shaft by any suitable means. A window 32 formed in the sleeve 28 provides space for mounting SAW devices, as will be understood by those skilled in the art. The SAW devices are connected to transmission lines formed on the first coupling parts 11, 11' by suitable wires (not shown).

The second parts 16, 16' of the coupling devices are themselves mounted on an outer carrier 33. The outer carrier 33 is rotated on the inner carrier 36 by means of a caged ball-bearing 34. Although in some instances the use of a plastic bearing may be desirable, it is believed that in the connection illustrated in FIG. 3 a metal ball-bearing will be acceptable provided that a relatively few balls are provided. Such an arrangement is possible with the use of a caged ball-bearing 34.

Referring to FIG. 4.1–4.6, various other embodiments of the invention are shown.

In the arrangement of FIG. 4.1 the second parts 16, 16' of the coupling are mounted in a carrier 23 which is itself mounted on the shaft (not shown) by means of a bearing 24. The bearing 24 is mounted on the shaft immediately adjacent the sleeve 11A on which the first parts 11, 11' of the coupling devices are mounted. The close proximity of the bearing 24 to the first parts 11, 11' of the coupling devices, together with a relatively small size of the carrier 23, ensures that the second parts 16, 16' of the couplings are maintained concentric and at an even spacing from the first parts 11, 11'.

The arrangement of FIG. 4.2 is generally similar to that illustrated in FIG. 2 save that the first parts 11, 11' of the couplings are formed mounted on an integral sleeve portion 11A for mounting on the shaft The second parts 16, 16' of the couplings are mounted on the first parts 11, 11' by means of a non-conducting ball race 18.

In FIG. 4.3 the second parts 16, 16' of the couplings are mounted on the first parts 11, 11' by means of a carrier 23 which forms a plain bearing 25 with the sleeve portion 11A of the first part.

In the arrangement of FIG. 4.4 the second parts 16, 16' of the couplings are again mounted on the first parts 11, 11' by means of a plain bearing 25.

In the case of both FIGS. 4.3 and 4.4 the plain bearing arrangements can conveniently be provided by making one or both of the bearing elements of the plastics material.

FIGS. 4.5 and 4.6 show arrangements suitable for mounting the coupling parts in an axially spaced apart arrangement. Coupling parts mounted this way require a consistent and substantially constant space between the coupling parts as the shaft rotates. This again can conveniently be achieved by mounting the second coupling parts 16, 16' on the shaft adjacent the mounting of the first coupling parts 11, 11' (FIG. 4.5) or by mounting the second coupling part on the fir coupling part by moans of a ball-bearing 18 (FIG. 4.6).

In use, each of the arrangements of FIG. 4 will utilize means of preventing rotation of the second coupling parts relative to the housing which surrounds them. The arrangement could consist of a steady pin 21 working in an oversized hole 22 as described above with reference to FIG. 2, or any other suitable rotation restraining arrangement.

Figure 1:
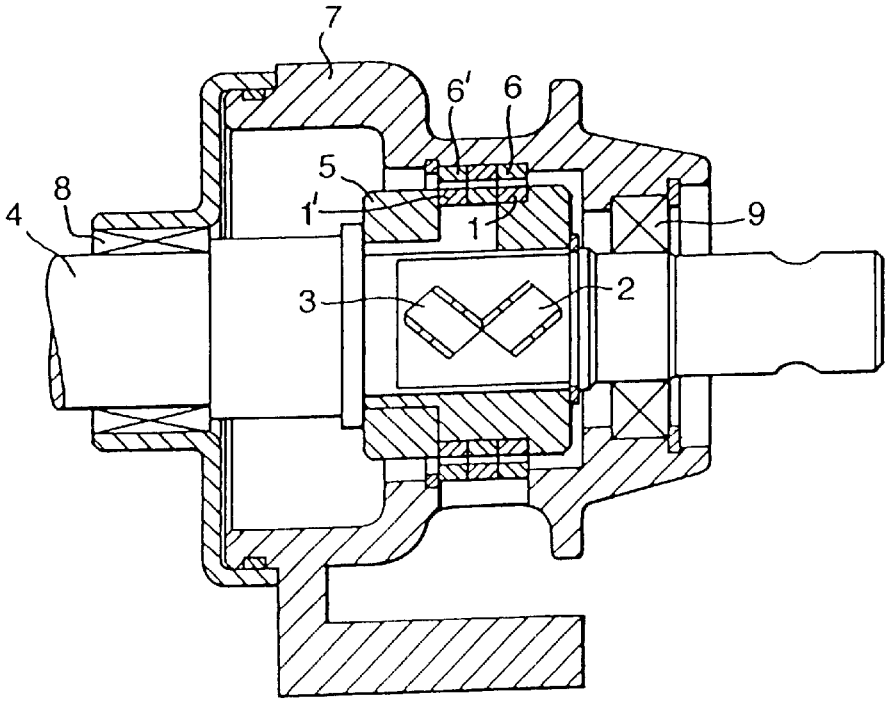
Fig. 1 (Prior Art)
FIG. 1 illustrates schematically an embodiment of prior art electrical signal coupling device.

It will be noted that the arrangements of FIGS. 2, 3, 4.2, 4.3, 4.4 and 4.6 are particularly advantageous in that the entire coupling device can be assembled as a unit and bench tested before it is applied to the shaft upon which it is required. This is in contrast to prior art arrangements shown in FIG. 1 where the first coupling part is mounted on the shaft and the second coupling part is mounted on the housing with the result that the complete coupling is not formed until after the housing bas been assembled to the shaft during manufacture of the product in which the coupling is employed.

Figure 5:
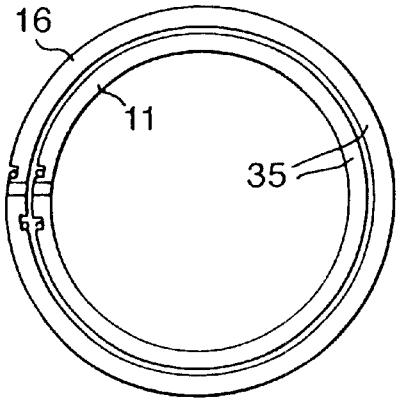
FIGS. 5–7 show schematically arrangements for providing the required coupling parts.
Figure 6:
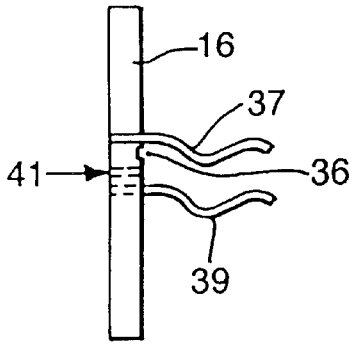
Figure 7:
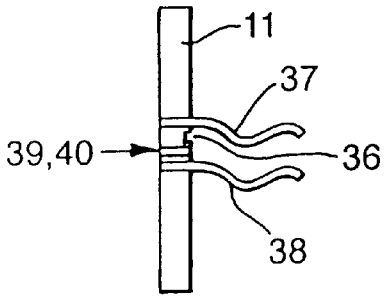

Referring now to FIGS. 5–7 one possible construction for the first coupling part 11 and the second coupling parts 16 is shown. Each coupling part comprises a base rings 35 formed from suitable non-conductive material. The base rings 35 may, for example, be plastics injection mouldings. Each base is coated on the radially inner and radially outer surface thereof with a conductive metal layer. The conductive layer may be provided by any suitable means, for example vacuum deposition, electro-plating, screen printing, or by the adhesion to the surface of the base rings 35 of tin metal strips. Each ring includes a slot 36 formed in one axial face thereof. The slots 36 house electrically conductive material which electrically connects the radially inner and radially outer faces of the respective rings. Suitable connections for ground wires 37 arc provided on the radially outer surfaces of both rings. A connection for a signal wire 38 is provided on the outer surface of the first coupling part whilst a N on for a signal wire 39 is provided on the radially inner surface of the second coupling part 16. The electrically conductive coating on the outer surface of the first coupling part 7 is broken by a gap 40 which is located between the columns for the wires 37 and 38. The electrically conductive coating on the inner surface of the second coupling part 16 is broken by a gap 41 located between the connection for the wire 39 and the slot 36 of the outer ring 35. The above described arrangements enable the coupling to be produced at relatively low cost and to have the necessary robust mechanical and electrical characteristics for use in the automotive industry.

What is claimed is:

1. An electrical signal coupling device for establishing a signal path between fixed wiring and a component mounted on a shaft which is rotatable relative to the fixed wiring, the coupling device comprising: a first part mounted on the rotary shaft; a second part mounted on the first part in juxtaposition to the first part, the first and second parts including respective conductors for capacitive coupling the first and second parts; means for maintaining a predetermined and substantially constant annular gap between the first and second parts as the shaft rotates relative to the fixed wiring; and means provided on the second part for preventing rotation of the second part relative to the fixed wiring as the first part rotates with the shaft.

2. An electrical signal coupling device according to claim 1 wherein the second part of the coupling device is mounted on the first part of the coupling device by means of a bearing.

3. An electrical signal coupling device according to claim 1 wherein the second part of the coupling device is mounted on the shaft by way of a bearing and is positioned to be maintained adjacent tie first part of the coupling device.

4. A coupler according to claim 1 wherein the second part of the or each electrical signal coupling device is annular and surrounds the corresponding first part of the or each electrical signal coupling device.

5. A machine comprising the shaft, and the electrical signal coupling device according to claim 1 mounted on the shaft; a housing surrounding the shaft; a clearance space between the housing and the second part of the electrical signal coupling device and an abutment on the housing for engaging the said means provided on the second part of the electrical signal coupling device for preventing rotation of the second part as the first part rotates with the shaft.

6. A machine according to claim 5 wherein the said means provided on the second part for preventing rotation of the second part is a pin secured to the second part and the abutment is provided by an aperture in the housing which is relative to the pin.

7. A coupler comprising two electrical signal coupling devices according to claim 1, the first part of each electrical signal coupling device being mounted on one carrier common to the first parts and the second parts of each electrical signal coupling device being mounted on a carrier common to the second parts.

8. A coupler according to claim 7 wherein the first electrical signal coupling device is axially spaced from the second electrical signal coupling device.

9. A coupler according to claim 8 wherein the carrier of the second parts of the electrical signal coupling devices is mounted on the carrier of the first part by means of a bearing located axially between the first and second electrical signal coupling devices.

* * * * *

UNITED STATES PATENT AND TRADEMARK OFFICE

CERTIFICATE OF CORRECTION

PATENT NO. : 6,478,584 B2 
DATED : November 12, 2002
INVENTOR(S) : David Daniel George Vile and John Beckley It is certified that error appears in the above-identified patent and that said Letters Patent is hereby corrected as shown below:

Column 5,
Line 31, delete "tie" and substitute -- the --

Signed and Sealed this

Twenty-fifth Day of February, 2003

JAMES E. ROGAN
*Director of the United States Patent and Trademark Office*